US005640823A

United States Patent [19]

Bergeron et al.

[11] Patent Number: 5,640,823

[45] Date of Patent: Jun. 24, 1997

[54] VERTICAL MOVEMENT CLIP FOR ATTACHING A BUILDING MEMBER TO A BEAM HAVING A CHANNEL THEREIN

[76] Inventors: Mark Bergeron, 17 Merrall Dr., Clifton Park, N.Y. 12065-7214; Lawrence C. Dippold, 26 Stony Brook Dr., Rexford, N.Y. 12148

[21] Appl. No.: 497,385

[22] Filed: Jun. 30, 1995

[51] Int. Cl.[6] ..... E04B 2/00

[52] U.S. Cl. ..... 52/715; 52/235; 52/236.7; 52/236.9; 52/573.1

[58] Field of Search ..... 52/235, 236.3, 52/236.6, 236.7, 236.9, 573.1, 781.3, 712, 713, 715

[56] References Cited

U.S. PATENT DOCUMENTS

| | | | |
|---|---|---|---|
| 1,723,500 | 8/1929 | Campbell | 52/715 |
| 2,598,139 | 5/1952 | Shea | 52/715 |
| 3,676,967 | 7/1972 | Frati | 52/715 X |
| 3,945,167 | 3/1976 | Wendt . | |
| 3,994,107 | 11/1976 | Aughuet | 52/235 |
| 4,018,020 | 4/1977 | Sauer et al. | 52/241 |
| 4,121,391 | 10/1978 | Schroeder . | |
| 4,194,333 | 3/1980 | Paton et al. | 52/235 |
| 4,433,524 | 2/1984 | Matson . | |
| 4,481,749 | 11/1984 | Stirling . | |
| 4,570,400 | 2/1986 | Slager et al. . | |
| 4,665,662 | 5/1987 | Swanborn | 52/235 |
| 4,800,698 | 1/1989 | Murphy . | |
| 5,216,858 | 6/1993 | Gilmour . | |
| 5,224,322 | 7/1993 | van den Toorn . | |
| 5,297,383 | 3/1994 | Mackay | 52/712 |
| 5,325,651 | 7/1994 | Meyer et al. | 52/712 X |

FOREIGN PATENT DOCUMENTS

| | | |
|---|---|---|
| 4272348 | 1/1992 | Japan . |

*Primary Examiner*—Carl D. Friedman
*Assistant Examiner*—Beth Aubrey
*Attorney, Agent, or Firm*—Schmeiser, Olsen & Watts

[57] ABSTRACT

A vertical movement clip for attaching a channeled beam or stud member to a horizontal building member. The clip has the advantage of easily sliding into the interior of the stud and wedging between two parallel legs of the stud member to fit securely therein. The clip also has the advantage of providing an attachment flange that securely attaches to and holds the floor to the stud and prevents most all horizontal movements and yet allows for vertical floor movement relative to the stud.

8 Claims, 2 Drawing Sheets

VERTICAL MOVEMENT CLIP FOR ATTACHING A BUILDING MEMBER TO A BEAM HAVING A CHANNEL THEREIN

BACKGROUND OF THE INVENTION

1. Field of the Invention

This invention relates to a vertical movement clip and system therefor for use in maintaining an exterior wall proximate a building framework. In particular, this invention relates to a vertical movement clip and retainer system for use with channeled beams.

2. Description of the Prior Art

In present day architecture most large buildings utilize a support structure framework comprising vertical steel columns with horizontal steel beams supported therebetween having floors and a roof attached thereto. This support structure is covered on the exterior with an exterior finish usually made up of panels or walls.

While the support structure, floors or roof are designed to bear a calculated maximum load they also must be permitted to compensate for live loads. Live loads, such as those due to weight applied to the floors and roof change frequently. The floors and roof must be designed to withstand such deflections but the walls must be isolated from such movement to prevent damage which would otherwise result from the compressive forces generated by the movement due to the loads. In addition, the walls must be fastened to floors and roof to withstand horizontal forces, such as variations in air pressure between the inside and outside of the building. Thus, means are needed to attach the walls to stud members or beams so that they may react to live loads.

Heretofore, various vertical movement clips have been suggested. L-shaped plates or clips have been used in the past which include a simple angle iron clip having a leg welded to a building support. The L-shaped plates or clips further include a side having an elongated slot to receive a bolt or screw to secure it to a C-shaped stud member. A difficulty with this bolt or screw is that it requires a permanent attachment of the clip or L shaped plate to an exterior C shaped channeled stud. Such attachment, if the bolts are too tight, would not compensate for building shifting and particularly the exterior building panels that are secured to the studs.

Another related art reference, U.S. Pat. No. 4,121,391, discloses a building having floors or roof resting on peripheral beams supported by columns and non-load bearing walls. The walls enclose the building and include a plurality of vertical members, constituting part of the wall framing, having at least one flange perpendicular to a horizontal member joined to the building, and a plurality of metal clips joined to the horizontal member and securing the vertical member flange against horizontal movement but permitting unrestrained vertical displacement of the adjoining horizontal member relative to the vertical members which are a part of the wall. In this way, roof and floor deflections do not apply compressive forces to the walls. Each clip may be made of sheet metal and have a planar metal body of substantially uniform thickness, with or without an integral planar metal flange laterally extending from the metal body, and an elongated opening of uniform width in the metal body extending inwardly from the lateral flange with the opening being adapted to smoothly receive a vertical flange of a wall vertical member of a wall.

Additionally, there is also a curtain wall stud slide clip covered by U.S. Pat. No. 4,570,400. This invention uses a clip for connecting a curtain wall stud to the load bearing framework of a building, and has dents so that the clip may be pushed onto the stud and does not have to be supported by hand while it is being welded to the framework.

Moreover, there is a vertical movement clip and C stud retainer system covered by U.S. Pat. No. 5,216,858. This invention uses a generally U shaped clip secured to a building support structure having a clip web portion and two legs projecting from the web with stiffening members and a slot projecting through said clip web and into the legs with the web on one side of the slot being on an offset plane from the web on the opposite side of the slot, and a C stud adapted to interfit with the clip to allow vertical movement of the stud yet prevent outward horizontal movement of C stud. The C stud is adapted to receive a non-load bearing exterior finish building panel.

SUMMARY OF THE INVENTION

An advantage of the present invention is to provide a clip for attachment of a wall having a channeled stud member or channeled beam, such as a C-beam, to a floor or roof. The clip has the advantage of easily sliding into the interior of the channeled beam and wedging between two parallel legs of the beam to slidably fit securely therein.

The clip also has the advantage of providing an attachment flange that compensates for various tolerances between the channeled beam and the floor. Thus, permitting a single size clip to be used throughout the building.

A further advantage of the present invention is that the clip engages both sides of the interior of the channeled beam thus limiting horizontal deflections in both directions and yet permitting vertical movement relative to the channeled beam.

These and other advantages will become apparent from the following part of the specification wherein details have been described in detailed description of the invention, without intending to limit the scope of the invention which is set forth in the appended claims.

BRIEF DESCRIPTION OF THE DRAWINGS

Similar numbers in the respective figures represent similar elements between the figures.

DETAILED DESCRIPTION OF THE INVENTION

Figure 1:
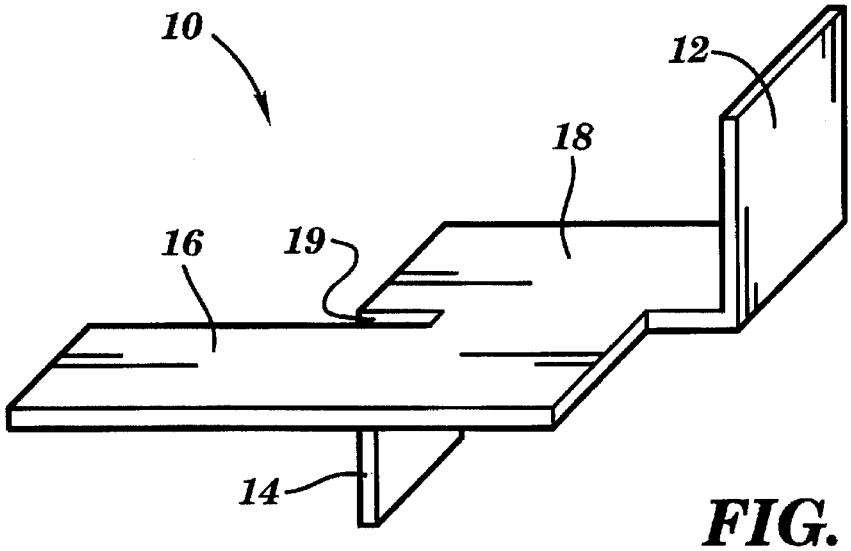
FIG. 1 is a perspective view of the clip of the present invention.

Referring to FIG. 1, there is a perspective view of the clip 10. In particular, the clip 10 has both a first arm 12 extending upward from a first end of a base plate 18, a second arm 14 extending downward from a second opposite end of the base plate 18, and a flange 16 attached to a side portion of the base plate. The first and second arms 12, 14 are relatively parallel to each other and perpendicular to the base plate and flange. The flange and base plate are in the same plane and have a slot 19 cut therebetween. The flange 16 and base plate 18 are parallel to each other, and the flange 16 extends well beyond the base plate 18.

Figure 2:
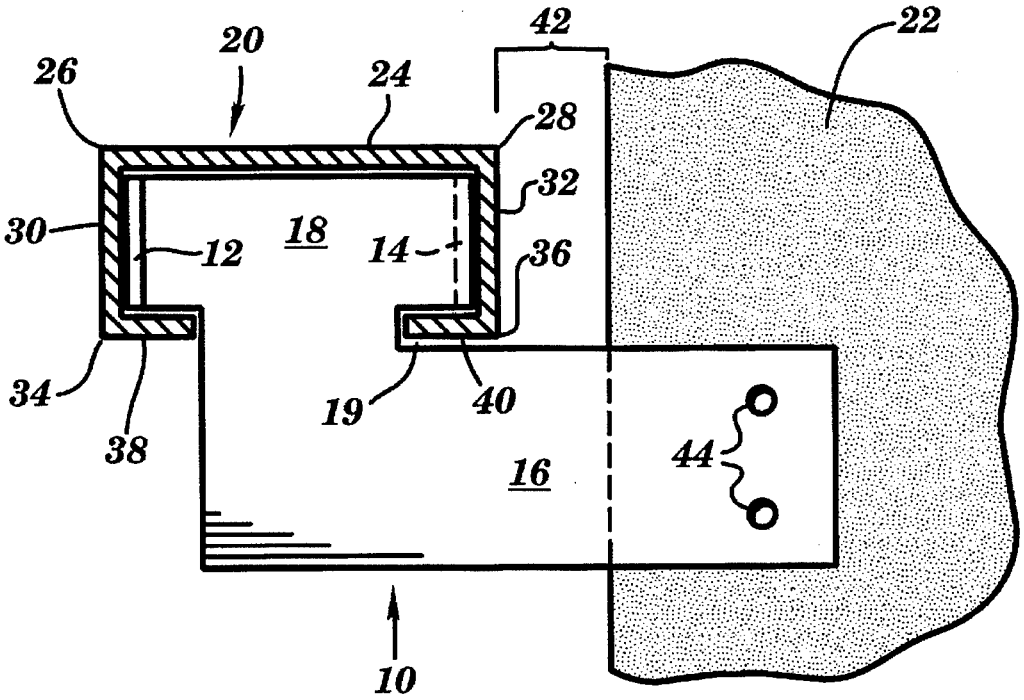
FIG. 2 is a top plan view of the clip of the present invention as attached to the floor and channeled beam support member.

Referring to FIG. 2, there is a top plan view of the clip 10 interlocked with the floor 22 and C stud or channel beam 20.

In particular, the C stud 20 has a web 24, first and second web bends 26 and 28, two parallel legs 30 and 32, two leg bends 34 and 36, and two inward extending fins 38 and 40. There is illustrated a gap 42 located between the C stud 20 and the floor 22. The clip 10 is shown having two holes 44, located on the end of the flange 16, that are used to secure bolts or other attachment means to the floor.

Figure 3:
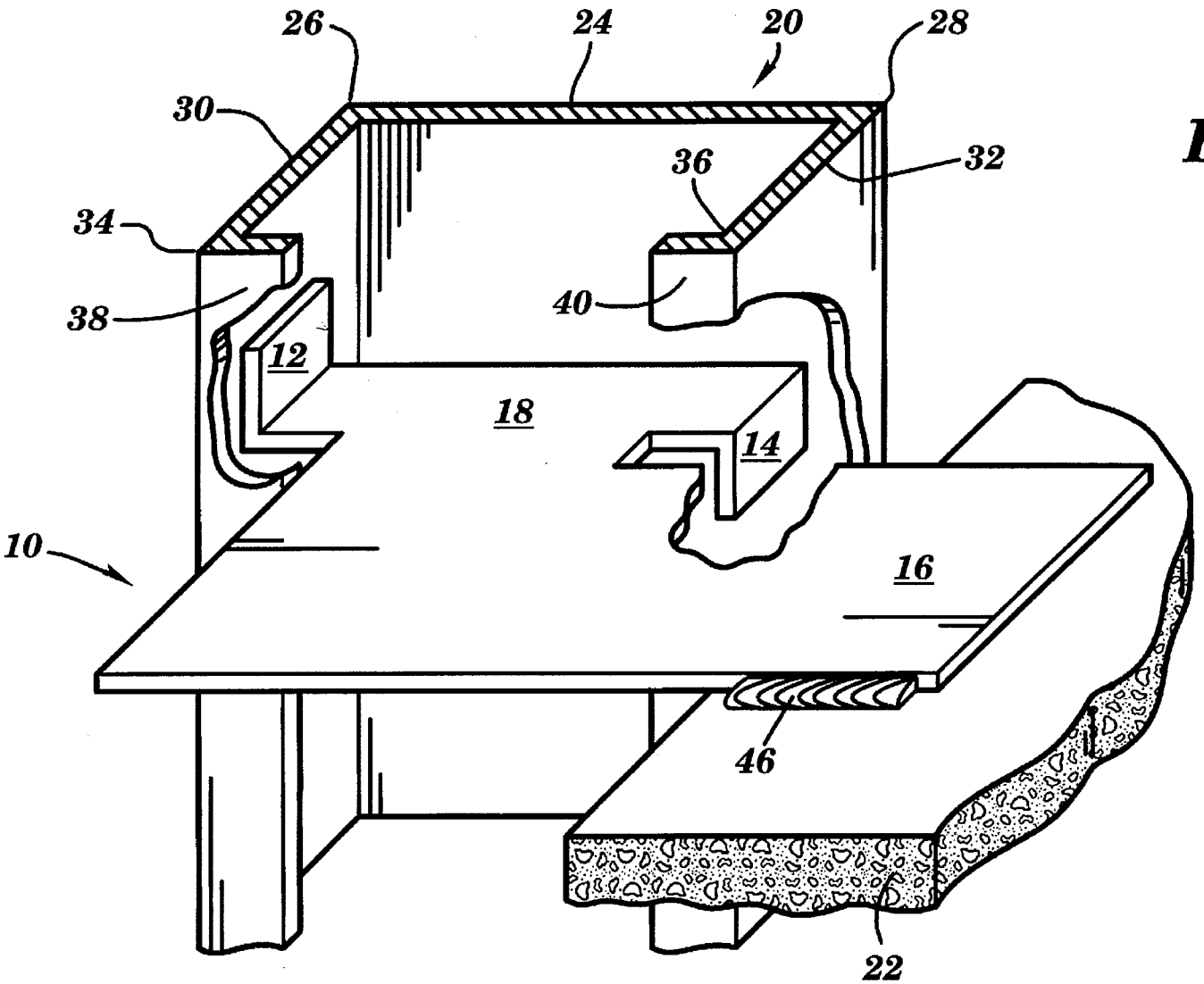
FIG. 3 is a perspective view of the clip of the present invention as attached to the floor and channeled beam support member.

Referring to FIG. 3, there is a perspective view of the clip interlocked with the floor 22 and C stud 20. In particular, one skilled in the art will note that the two clip arms 12 and 14 are snugly fitted between the two parallel legs 30 and 32 of the C stud 20. It is illustrated in this figure a second means of attaching Clip 10 to the floor 22 by welding 46.

A skilled artisan will easily understand that the shape of the clip 10 allows for easy mounting to the C stud. Specifically, the clip 10 can be easily inserted into the C stud by positioning the flange 16 in a downward direction. The clip arms 12 and 14 are sized to fit between fins 38 and 40 for easy insertion of the arms 12 and 14 and the base plate 18 into the inner portion of the C stud. Thereafter, the clip 10 can be rotated into the position illustrated in FIG. 3, and thereby allowing for secure attachment to the floor 22. It is additionally noted that the current invention allows for the floor to be spaced apart from the C stud.

One skilled in the art will immediately notice the advantages of the present invention. Specifically, by having both arms 12 and 14 so designed, compression and tension loads are easily transferable to both parallel legs 30 and 32 on the C stud. Additionally, the clip leg design eliminates the previous need to use shims between prior clip designs and the C stud. Also, the current design does not require the clip to be permanently secured to the C stud, thus allowing for relative movement between the floor and C stud.

There are many variations to the invention that are easily incorporated into the present invention. Specifically, the arms of the clip can be of most any shape and not as the square shape as illustrated. This also holds true for the flange 16. Additionally, any means of attaching the floor to the clip is contemplated by this invention. The standoff distance or gap 42 can be varied to accommodate for the weight of the flooring and strength of the clip. In particular, the clip has been tested to allow for about a three inch standoff at about one thousand five hundred pounds. Moreover, although the specification notes that the clip is attached to a floor and C stud, it is contemplated that the clip can be used to attach to planks, beams or other such devices and to studs that have all varieties of shapes and variation as are developed in the market place. Also, it is contemplated that the material used to fashion the clip 10 can be of any suitable type, like plastic, fiber, or ceramic, but preferably of a metal alloy or composite material.

The invention and its attendant advantages will be understood from the foregoing description and it will be apparent that various changes may be made in the form, construction, and arrangements of the parts without departing from the spirit and scope thereof or sacrificing its material advantages.

What is claimed is:

1. A clip comprising:

a) a plane base plate having a first edge, a second edge, and a third edge the second edge opposite the first edge;

b) a first arm extending perpendicular to said first edge of said base plate;

c) a second arm extending perpendicular to said second edge of said base plate, wherein said first and second arms are parallel and oriented in opposite directions; and d) a flange extending from said third edge of said base plate and being coplanar with said base plate, wherein a slot is defined between said flange and said base plate.

2. The clip of claim 1, further comprising at least one slot between said flange and said base plate.

3. The clip of claim 2, wherein the clip flange is shaped to be fastened to a horizontal member on a building with the base plate, first and second arm being positioned within a hollow stud so as to define a gap between the stud and member.

4. A clip for attaching a floor to a C-shaped beam having a first leg and a second leg, the first leg opposite the second leg, the clip comprising:

a) a base plate being planar, having a first edge and a second edge, the second edge opposite the first edge;

b) a first arm being attached perpendicular to said first edge of the base plate;

c) a second arm being attached perpendicular to said second edge of the base plate, and being parallel to the first arm and oriented opposite in direction;

d) the base plate, first and second arm being slidably positionable within the C-shaped beam to allow for vertical movement of the clip within the C-shaped beam, the first arm contacting said first leg of the beam, the second arm contacting within said second leg of the beam; and e) a flange attached to a side portion of the base plate, being in a same plane as the base plate, the base plate defining a slot therebetween, wherein the flange and base plate and flange are parallel to each other and the flange extends beyond the base plate, the flange is fastenable to the floor so as to define a gap between the C-shaped beam and the floor.

5. Apparatus comprising:

a) a planar building member;

b) a beam having a channel therein; and c) a clip having a base plate;

engagement arms, angularly extending from said base plate and slidably engaging both sides of said channel; and a flange, extending from said base plate and fastened to said building member wherein a slot is defined between the base plate and flange for receiving a portion of said beam therein.

6. The apparatus of claim 5, wherein a first of said engagement arms angularly extends above the plane of said base plate in a first direction and a second of said engagement arms angularly extends below the plane of said base plate in a second direction opposite said first direction.

7. The apparatus of claim 6, wherein said engagement arms are slidably engaged parallel to the sides of said channel.

8. The apparatus of claim 5, wherein said base plate and said flange are coplanar.

* * * * *